US006077117A

United States Patent [19]

Iwahori

[11] Patent Number: 6,077,117

[45] Date of Patent: Jun. 20, 2000

[54] CONNECTOR HAVING AN OPENING WHICH ALLOWS ACCESS OF A JIG ROD TO REMOVE A HOLDER

[75] Inventor: Yoshihiro Iwahori, Shizuoka, Japan

[73] Assignee: Yazaki Corporation, Tokyo, Japan

[21] Appl. No.: 09/176,938

[22] Filed: Oct. 22, 1998

[30] Foreign Application Priority Data

Oct. 24, 1997 [JP] Japan ..... 9-292891

[51] Int. Cl.[7] ..... H01R 13/40

[52] U.S. Cl. ..... 439/595

[58] Field of Search ..... 439/595, 744

[56] References Cited

U.S. PATENT DOCUMENTS

| | | | |
|---|---|---|---|
| 4,565,416 | 1/1986 | Rudy et al. | 439/595 |
| 4,992,064 | 2/1991 | Steinhardt et al. | 439/595 |
| 5,674,088 | 10/1997 | Roche et al. | 439/595 |

FOREIGN PATENT DOCUMENTS 5-121116 5/1993 Japan .

*Primary Examiner*—Neil Abrams
*Attorney, Agent, or Firm*—Sughrue, Mion, Zinn, Macpeak & Seas, PLLC

[57] ABSTRACT

A connector which can remove the provisionally retained state of a front holder simply and positively. In the connector, a flexible, provisionally-retaining projecting portion (39) is formed in a front holder (4) for retaining a terminal to be inserted into a connector housing (2), a provisionally retaining portion (45) of the provisionally-retaining projecting portion (39) is engageable with a provisionally engaging portion of the connector housing (2), and, in the connector housing (2), there is formed an opening (7*a*) for insertion of a jig rod (12) while the opening is allowed to communicate with the provisionally-retaining projecting portion (39) in the provisionally retained state of the front holder (4). The opening (7*a*) is formed in a flexible lock arm (8) so that the opening (7*a*) can serve also as a lock hole (7) with respect to a mating connector. The end edge of the opening (7*a*) operates as a leverage fulcrum (13*a*) with respect to the provisionally-retaining projecting portion (39). In the connector housing (2), there is formed a guide portion (25) for sliding engagement with respect to the provisionally-retaining projecting portion (39) and, in this guide portion, there is formed an opening (25) into which the leading end of a jig rod (12) can be inserted. The front holder (4) is stored into the connector housing (2) while it is held in the provisionally retained state thereof.

16 Claims, 6 Drawing Sheets

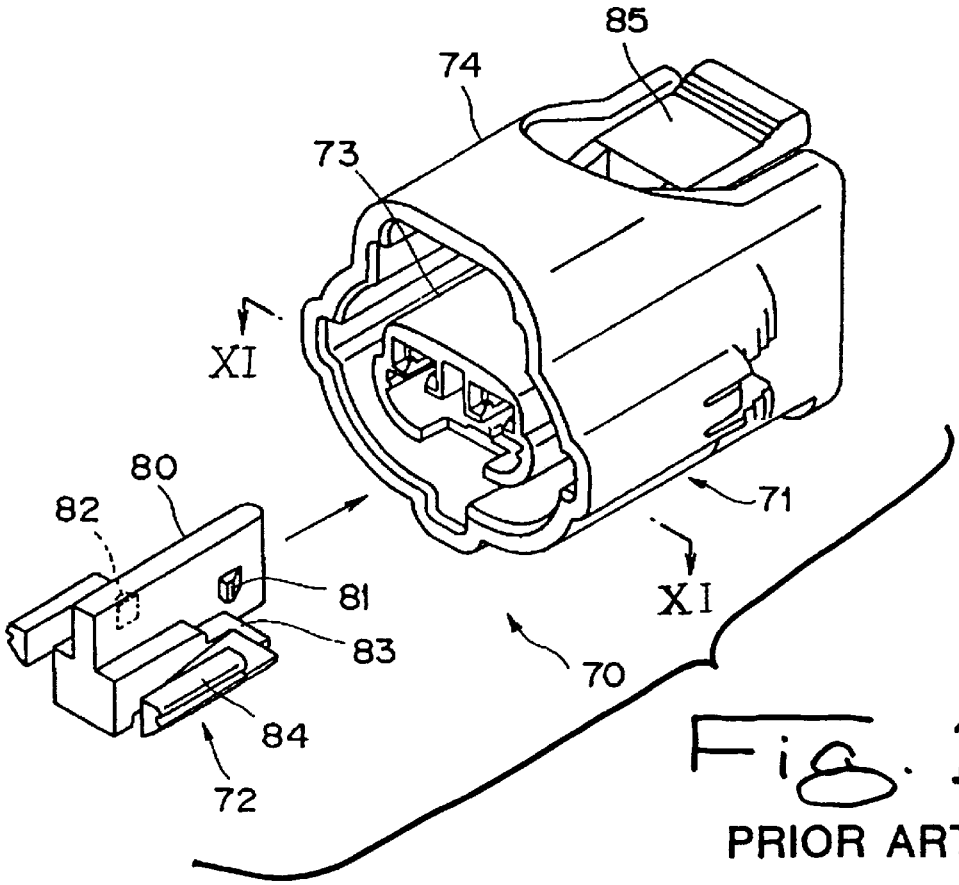
Fig. 10
PRIOR ART
Fig. 11
PRIOR ART
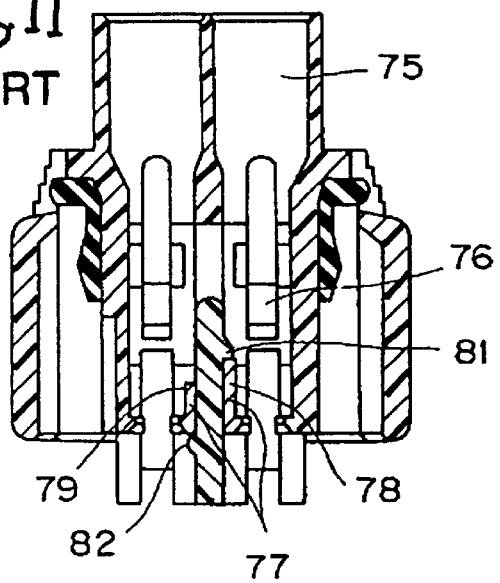

CONNECTOR HAVING AN OPENING WHICH ALLOWS ACCESS OF A JIG ROD TO REMOVE A HOLDER

BACKGROUND OF THE INVENTION

1. Field of the Invention

The present invention relates to a connector in which the provisionally retained state of a terminal-retaining front holder to be inserted into a connector housing can be removed simply by use of a jig rod.

The present application is based on Japanese Patent Application No. Hei. 9-292891, which is incorporated herein by reference.

2. Description of the Related Art

FIG. 10 is an exploded perspective view of a conventional connector with a holder, and FIG. 11 is a sectional view taken along the line XI—XI shown in FIG. 10. The conventional connector 70 comprises a connector housing 71 made of synthetic resin, and a front holder 72 which is made of synthetic resin and can be inserted into the connector housing 71 from the front thereof.

The connector housing 71 includes an internally located male housing part 73 and an externally located hood part 74. In the interior portion of the male housing part 73, there are formed a plurality of terminal receiving chambers 75 (see FIG. 11). Within each of the terminal receiving chambers 75, there is disposed a flexible terminal retaining lance 76 and, on the side walls of each of the terminal receiving chambers 75, there are formed two engaging stepped portions 78 and 79 which are spaced from each other in the front holder insertion direction and respectively correspond to the front holder 72; in particular, the engaging stepped portion 78 is used for provisional retaining of the front holder, whereas the engaging stepped portion 79 is used for primary retaining of the front holder.

The front holder 72 is structured such that it can be inserted into the interior portion of the male housing part 73 and includes, in its centrally located vertical base plate portion 80, a provisionally retaining projection 81 and a primarily retaining projection 82 which respectively correspond to the above-mentioned engaging stepped portions 78 and 79. Also, the front holder 72 further includes, on the lateral side of the base plate portion 80, a horizontally-extending projecting plate 83 which corresponds to the terminal retaining lance 76. The projecting plate 83 is used to prevent, for example, the terminal retaining lance 76 from being flexed to thereby prevent a terminal from being removed backwardly from the terminal retaining lance 76 (in the present structure, the projecting plate 83 has a function to remove the terminal retaining lance 76). Reference numeral 84 designates an insertion guide portion.

Also, in the hood part 74, there is provided a flexible lock arm 85 which corresponds to a mating side female connector (not shown).

In the above-mentioned conventional structure, however, in order to prevent the removal of the front holder 72 while it is provisionally retained, a retaining state holding force provided by the provisionally retaining projection 81 and provisionally engaging stepped portion 78 must be set high to a certain degree: in particular, for example, when there arises the need for replacement of the front holder 72 and/or the connector housing 71 because of damage, if the retaining state holding force is high, the front holder 72 cannot be removed from the connector housing 71 easily, which results in the damaged or deformed provisionally retaining projection 81 and provisionally engaging stepped portion 78. This problem similarly arises in the primarily retained state as well. Also, in recent years, in recycling production, when the connector housing 71 and front holder 72 are different in material, since disassembling operation for the connector 70 is a troublesome work, it may be difficult to recycle.

SUMMARY OF THE INVENTION

In order to eliminate the above-described drawbacks accompanying the conventional connector, it is an object of the present invention to provide a connector in which the provisionally retained state of a front holder of the connector can be removed simply and positively while preventing damage of a provisionally retaining portion and a provisionally engaging portion of the connector.

According to the first aspect of the present invention, there is provided a connector which comprises: a connector housing including a terminal receiving chamber and a provisionally engaging portion; a terminal insertable into the terminal receiving chamber; and a front holder insertable into the connector housing to retain the terminal in the terminal receiving chamber, the front holder including a provisionally-retaining projecting portion having a flexibility, the provisionally-retaining projecting portion including a provisionally retaining portion engageable with the provisionally engaging portion of the connector housing; wherein the connector housing includes an opening which allows access of a jig rod to the provisionally-retaining projecting portion of the front holder when the front holder is held in the provisionally retained state.

According to the second aspect of the present invention, the connector housing may further include a flexible lock arm, and in this case, the opening may be formed in the flexible lock arm, and serve as a lock hole with respect to a mating connector. According to the third aspect of the present invention, an end edge of the opening operates as a leverage fulcrum with respect to the jig rod. According to the fourth aspect of the present invention, the connector housing may further include a guide portion for sliding engagement with respect to the provisionally-retaining projecting portion of the front holder, the guide portion has an opening into which a leading end of the jig rod is insertable. According to the fifth aspect of the present invention, the front holder may be stored into an interior of the connector housing when the front holder is held in the provisionally retained state.

BRIEF DESCRIPTION OF THE DRAWINGS

FIG. 10 is an exploded perspective view of the conventional connector with the holder; and FIG. 11 is a sectional view taken along the line XI—XI shown in FIG. 10, illustrating the provisionally retained state of the front holder employed in the conventional connector.

DETAILED DESCRIPTION OF THE PREFERRED EMBODIMENT

Now, description will be given below in detail of an embodiment of a connector with a holder according to the present invention with reference to FIGS. 1 to 9.

Figure 1:
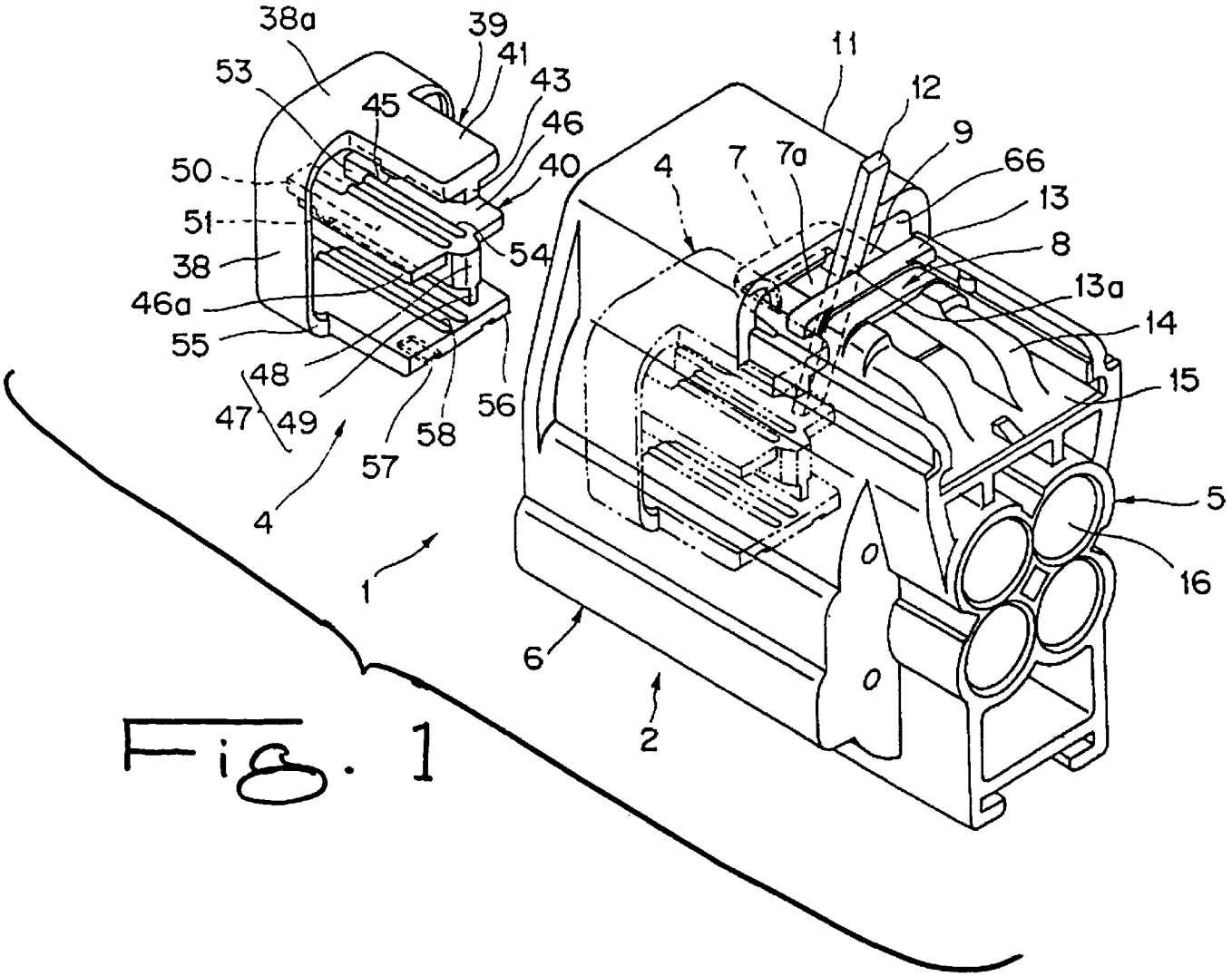
FIG. 1 is an exploded perspective view of an embodiment of a connector with a holder according to the present invention.

As shown in FIG. 1, a connector 1 according the present embodiment of to the present invention, similarly to the conventional structure, comprises a connector housing 2 made of synthetic resin, a female terminal 3 (see FIG. 8) to be inserted into the connector housing 2 from the behind thereof, and a front holder 4 which is made of synthetic resin and can be inserted into the connector housing 2 from the front thereof.

The connector housing 2 includes an internally located male housing part 5 (see FIG. 2) and an externally located hood part 6 which are formed together into a united body and, in the hood part 6, there is formed an opening 7*a* for removing the provisionally retained state of the front holder 4; in particular, the opening 7*a* is a characteristic of the present invention. The opening 7*a* is part of a lock hole 7 formed inside a front-half section of a frame-shaped portion 9 of a flexible lock arm 8. The front half section of the frame-shaped portion 9 is hidden inside an expansion portion 11 which is part of the hood part 6 and has a longitudinal section of a substantially inverted concave shape, whereas the rear half section of the frame-shaped portion 9, that is, the rear half section of the lock hole 7 is exposed backwardly from the expansion portion 11 to thereby form the opening 7*a*. The rear end of the expansion portion 11 is opened to thereby form a rear opening 66 and the leading end side of the lock arm 8 is inserted into the expansion portion 11 through the rear opening 66. Also, a lock portion of a mating female connector (not shown) is inserted into the expansion portion 11 through a front opening 36*a* (see FIG. 2) formed in the front end portion of the expansion portion 11, so that the lock portion (for example, an engaging projection) can be engaged with the lock hole 7 of the lock arm 8.

A jig rod 12 for removing the provisionally retained state of the front holder can be inserted into the opening 7*a* from above. In the meantime, the jig rod 12 may also be replaced with a fine minus driver or the like. Integrally with the rear portion of the opening 7*a*, there is formed a connecting portion 13 which connects the frame-shaped portion 9 with the opening 7*a* in the transverse direction thereof. The front end of the connecting portion 13 serves as a leverage fulcrum 13*a* for rotational operation with respect to the jig rod 12. The lock arm 8 includes a curved base portion 14 which is so formed as to continue integrally with the rear upper wall 15 of the hood part 6.

Figure 2:
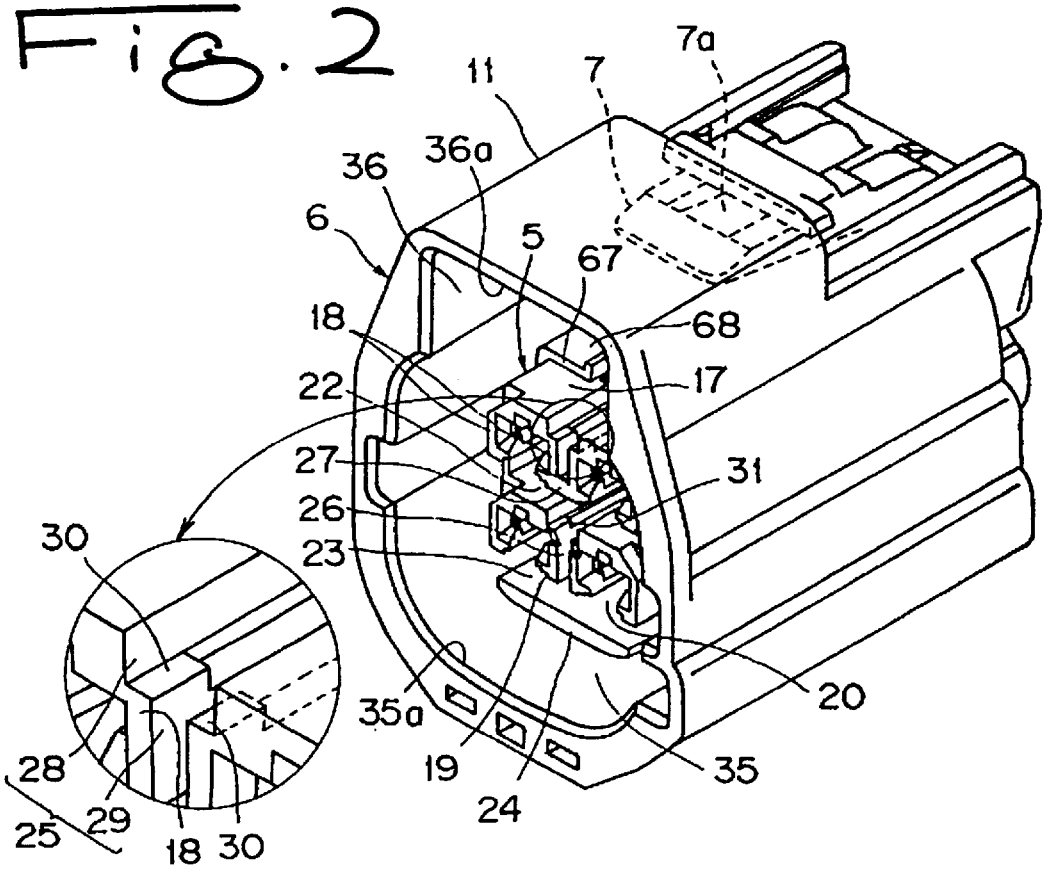
FIG. 2 is a perspective view of a connector housing employed in the above embodiment.

In the male housing 5 located internally of the hood part 6, there are formed a plurality of (in the present embodiment, four) terminal receiving chambers 16 arranged in two upper and low stages. As shown in FIG. 2, the front half section of each terminal receiving chamber 16 is defined or enclosed by an upper wall 17 and two side walls 18, whereas the lower wall 19 thereof is cut in the front holder insertion direction in the form of a slit. In the rear portion of the thus cut-away portion 20, there is disposed a flexible retaining lance 21 (see FIG. 8) for retaining a terminal.

There are formed horizontally extending guide gaps 22 and 23 under the respective cut-away portions 20, for insertion of the front holder. The guide gaps 22 and 23 are arranged in two stages. That is, the guide gaps 22 and 23 are respectively formed between the upper and lower terminal receiving chambers 16, and between the lower terminal receiving chambers 16 and the bottom plate portion 24 of the male housing part 5. Also, between the right and left terminal receiving chambers 16 (in more particular, between the mutually opposing side walls 18 thereof), there are formed vertically extending guide gaps (guide portions) 25 and 26 for insertion of the front holder. In the bottom portion of the guide gap 25, there is formed a connecting wall 27 which extends in the horizontal direction. Each of the guide gaps 25 and 26 is formed in a stepped or staged manner; that is, it includes an upwardly located large width portion 28 which forms an upper stage and a downwardly located narrow width portion 29 forming a lower stage.

On the front end side of the wide width portion 28 of the upper-stage guide gap 25, there are provided a pair of right and left provisionally engaging projections 30 (provisionally engaging portions) with respect to the front holder 4 and, on the front end side of the wide width portion of the lower-stage guide gap 26, there are provided a pair of right and left provisionally engaging projections 31 with respect to the front holder 4. Each of the engaging projections 30 and 31 is formed substantially in a rectangular shape.

Figure 3:
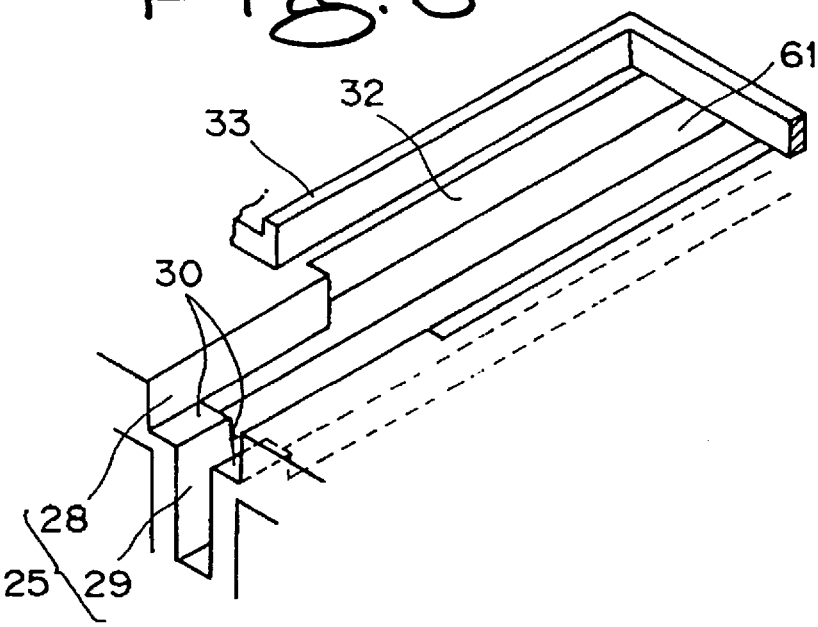
FIG. 3 is a perspective view of a guide portion the above connector housing.

As shown in FIG. 3, in the front portion of the upper-stage vertically extending guide gap 25, there is located the wide width portion 28 and, in the rear of the wide width portion 28, there is formed an opening 32 which is wider in width than the wide width portion 28. There is located the narrow width portion 29 under the opening 32. On the two sides of the opening 32, there are formed two guide ribs 33 for sliding positioning with respect to the front holder 4. Upwardly of the opening 32, there is positioned the opening 7*a* of the lock arm 8 (see FIG. 1). Between the opening 32 and opening 7*a*, there is formed an insertion space (see FIG. 5) with respect to a mating female connector.

In FIG. 2, between the male housing part 5 and hood part 6, there is formed a substantially rectangular and annular insertion gap 35 with respect to a mating female connector. The front end of the male housing part 5 is positioned such that it stands back inwardly from the front end of the hood part 6. The outer periphery of the male housing part 5 on the front end side thereof is cut away to the plate thickness dimension of a frame-shaped portion 38 (see FIG. 1) of the front holder 4 to thereby form a cutaway portion 67. That is, the frame-shaped portion 38 can be fitted with the cutaway portion 67, so that the outer surface of the frame-shaped portion 38 and the rear outer surface 68 of the male housing part 5 can be positioned on the same plane. The inside space 36 of the expansion portion 11 formed in the upper portion of the hood part 6 communicates with the insertion gap 35 and with the insertion space 34 (see FIG. 5), while the front opening 36*a* of the expansion portion 11 is contained within the front opening 35*a* of the hood part 6.

Figure 4:
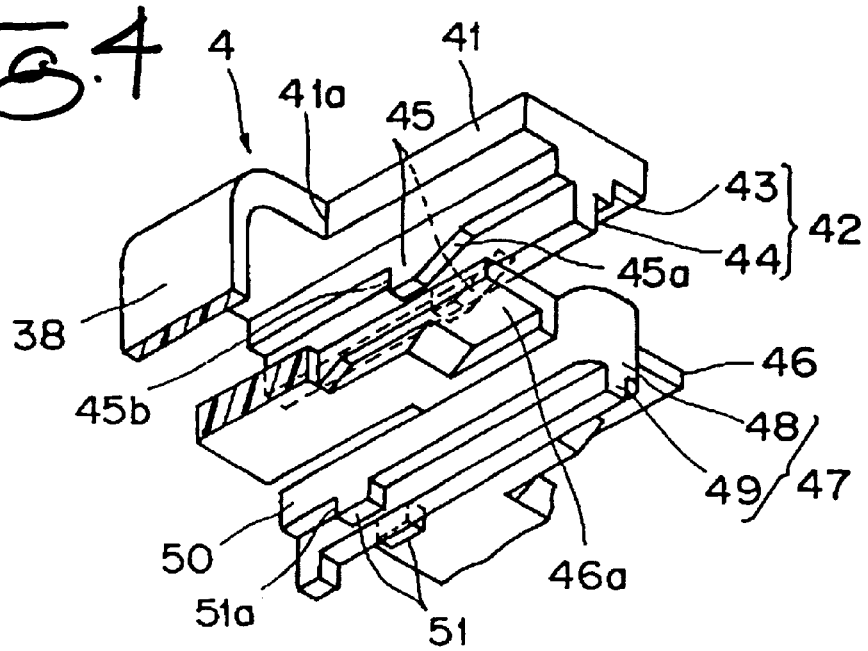
FIG. 4 is a perspective view of a front holder employed in the above embodiment.

As shown in FIGS. 1 and 4, the front holder 4 comprises a substantially rectangular frame-shaped portion 38, a flexible, provisionally-retaining projecting portion 39 which is provided on and projected from the upper side portion 38*a* of the frame-shaped portion 38 in the front holder insertion direction, and a flexible, primarily retaining, projecting portion 40 which is provided on and projected from the height-direction central portion of the frame-shaped portion 38 in the front holder insertion direction.

The provisionally-retaining projecting portion 39 includes a flat-plate-shaped flexible plate 41 extending straight in the horizontal direction, a stepped slide portion 42 including a wide width portion 43 and a narrow width portion 44 (see FIG. 4) respectively so formed as to hang down from the central portion of the flexible plate 41, and a pair of provisionally retaining projections 45 (provisionally retaining portions) respectively provided on the two sides of the narrow width portion 44. The slide portion 42 is formed such that it extends up to the rear end of the frame-shaped portion 38. And, the provisionally retaining projections 45 are respectively provided substantially on the central portion of the slide portion 42 in the longitudinal direction, are suspended down from the narrow width portion 43, and are united together with the narrow width portion 44; and, further, the provisionally retaining projections 45 include an gently inclined surface 45*a* for sliding contact on the front side of the holder insertion direction, and a substantially vertically extending, provisionally retaining surface 45*b* on the rear side of the front holder insertion direction.

The flexible plate 41 is slidably contacted along the upper wall 17 of the male housing 5 shown in FIG. 2. In the upper wall 17, there is projectingly provided the guide rib 33 (see FIG. 3) with respect to the flexible plate 41. The slide portion 42 is engageable with the upper-stage vertical guide gap 25 (see FIG. 2). Each of the provisionally retaining projections 45 is structured such that the inclined surface 45*a* thereof can move beyond the provisionally engaging projection 30 (see FIG. 2) and the provisionally retaining surface 45*b* thereof can be contacted with the rear end of the provisionally engaging projection 30. When the provisionally retaining projection 45 is moving beyond the provisionally engaging projection 30, the flexible plate 41 can be flexed upwardly together with the slide portion 42 from the root portion 41*a* thereof.

The primarily retaining projecting portion 40 includes a horizontally extending slide plate 46 having a width larger than the flexible plate 41, a staged-slide portion 47 including a wide width portion 48 and a narrow width portion 49 which are respectively so formed as to hang down from the central portion of the slide plate 46, and a flexible, primarily retaining arm 50 which is provided in the rear half section of the slide portion 47 but is formed separately from the slide plate 46. The primarily retaining arm 50 includes a pair of primarily retaining projections 51 which are respectively formed near the rear portion thereof and on the two sides of the narrow width portion 49. Each of the primarily retaining projections 51 is formed in a substantially rectangular shape and includes a primarily retaining surface 51*a* which is formed on the rear side thereof and extends almost in the vertical direction.

Figure 8:
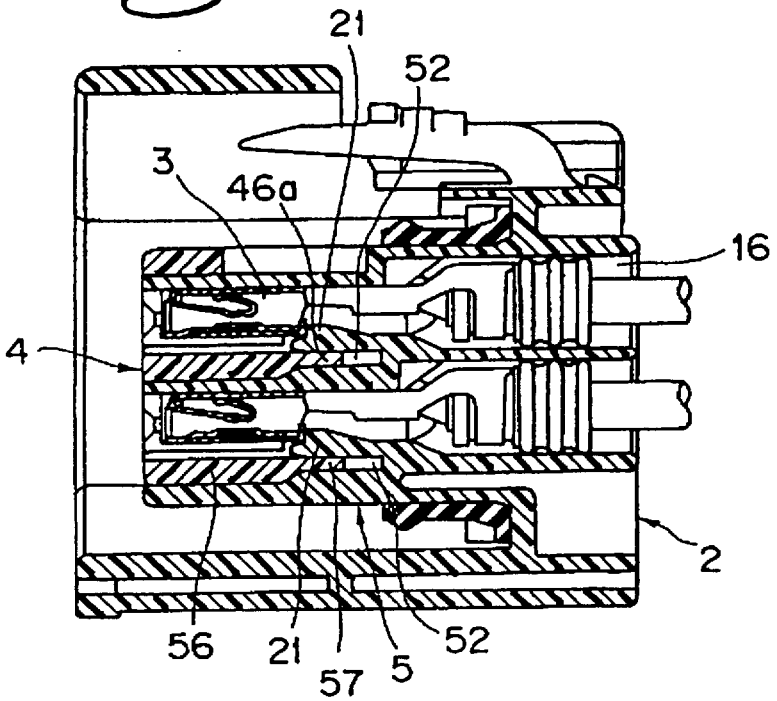
FIG. 8 is a longitudinal sectional view of the above embodiment, showing a state in which the front holder is primarily retained.

The front half section 46*a* of the slide plate 46 is formed small in thickness and serves as a flexure preventive plate which is able to advance into a flexure space 52 of the flexible retaining lance 21 provided within the male housing part 5 (see FIG. 8). In the rear portion of the slide plate 46, there is formed a rectangular-shaped cutaway portion 53 which is opposed to the primarily retaining arm 50. The cutaway portion 53 operates as a space to allow the primarily retaining arm 50 to flex when removing the retained state of the front holder 4 or the like.

The slide plate 46 is structured such that the rear end side thereof is connected with the frame-shaped portion 38. On the upper surface of the slide plate 46, there is provided a projecting strip 54 for sliding contact with the upper-stage connecting wall 27 (see FIG. 2). In the meantime, when four upper-stage terminal receiving chambers 16 are set, on the right and left sides of the slide plate 46, there are provided two flexure preventive plates with respect to the flexible retaining lance 21, in particular, one flexure preventive plate for each side.

The slide plate 46 can be moved into the horizontal gap 22 shown in the central portion of FIG. 2, while the slide portion 47 of the slide plate 46 can be moved into the lower-stage vertical guide gap 26. The primarily retaining projection 51 of the primarily retaining arm 50 can be moved beyond and engaged with the primarily engaging projection 31.

As shown in FIG. 1, a slide plate 56 is provided on and projected from the bottom side portion 55 of the frame-shaped portion 38 in the holder insertion direction. The slide plate 56 can be inserted into the lower-stage horizontal guide groove 23 shown in FIG. 2. The slide plate 56 includes a pair of small thickness portions 57 respectively formed in the two sides thereof. The small thickness portions 57 respectively operate as flexure preventive portions with respect to the flexible retaining lance 21 (see FIG. 8). On the upper surface of the slide plate 56, there is provided a projecting strip 58 for sliding contact with the lower wall 19 (see FIG. 2) of the lower-stage terminal receiving chamber. In the meantime, the slide plate 56 may also be structured such that it is separated into right and left sections.

Figure 5:
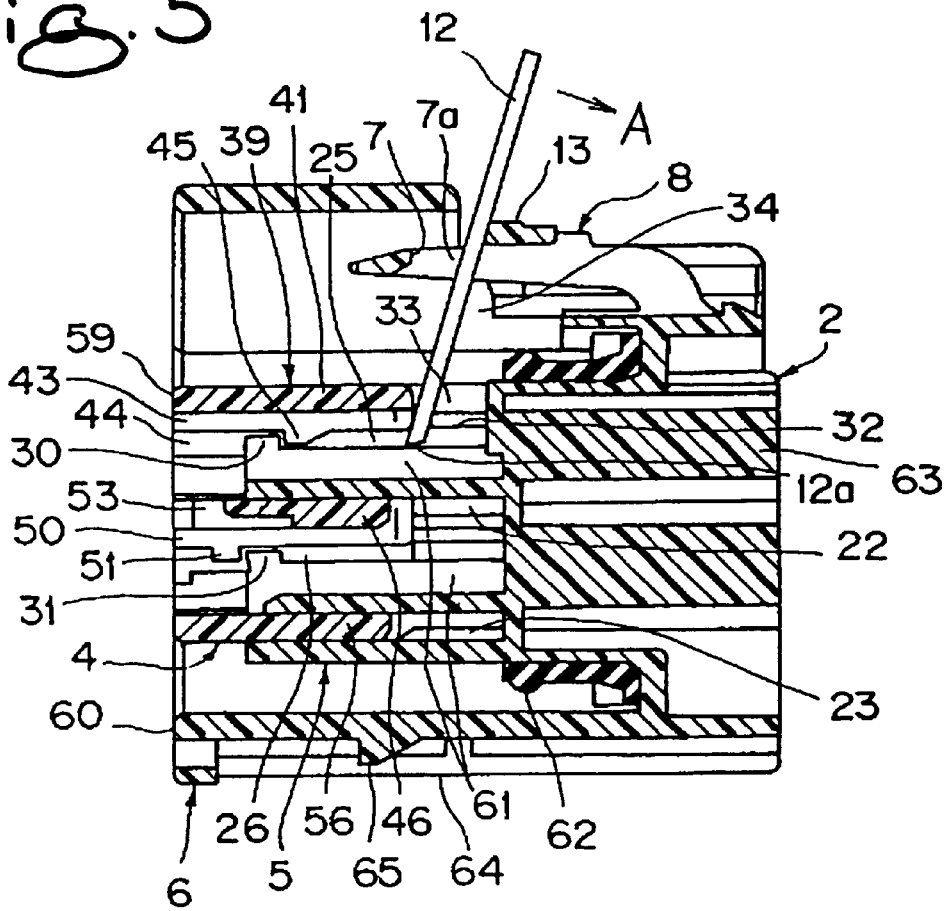
FIG. 5 is a longitudinal sectional view of the above embodiment, showing a method for removing the provisionally retained state of the front holder.

Now, FIG. 5 shows a state in which the front holder 4 is provisionally retained to the connector housing 2. In particular, the provisionally retaining projections 45 of the front holder 4 are respectively moved beyond and engaged with the provisionally engaging projections 30 of the male housing part 5, thereby preventing the front holder 4 from being removed in the backward direction. Also, the primarily retaining projections 51 are respectively contacted with the primarily engaging projections 31, thereby preventing the front holder 4 from being primarily retained unexpectedly with a weak pushing force.

The rear end 59 of the front holder 4 is situated on the same plane with the front end 60 of the hood part 6 and will not be projected outwardly of the hood part 6. This eliminates the possibility that the front holder 4 can interfere with some external thing during the provisionally retained state thereof, which in turn prevents the front holder 4 from being removed unexpectedly. For this reason, even if the provisionally retaining force of the front holder 4 is small, there arises no problem. Since the provisionally retaining projections 45 of the front holder 4 are respectively formed integrally with the flexible plate 41, the provisionally retaining force of the front holder 4 is smaller than the conventional connector, which can facilitate the provisionally retaining operation as well as the provisionally retained state removing operation.

The flexible plate 41 is inserted along the guide rib 33. The central slide plate 46 is inserted along the horizontal guide gap 22. The primarily retaining arm 50 extends backwardly of the slide plate 46. The lower slide plate 56 is inserted along the lower guide gap 23.

The provisionally engaging projections 30 and primarily engaging projections 31 of the male housing part 5 are respectively situated in the wide width portions 28 (see FIG. 3) of the upper and lower vertical guide gaps 25 and 26, while the side walls 61 of the narrow width portions 29 (see FIG. 3) are respectively situated in the rear of the provisionally engaging projections 30 and primarily engaging projections 31 of the male housing part 5. The provisionally retaining projections 45 are engaged with the rear sides of the provisionally engaging projections 30 and, as shown in FIGS. 2 and 3, can be moved along the wide width portions 28 onto the side walls 61 of the narrow width portions 29.

In FIG. 5, in the flexible lock arm 8 of the hood part 6, there are formed the opening 7*a* and connecting portion 13; there is situated the insertion space 34 with respect to a mating female connector under the opening 7*a*; there is situated the opening 32 of the male housing part 5 into which the provisionally retaining under the insertion space 34, projecting portion 39 can be engaged; and, there is situated the vertical guide gap 25 under the opening 32. And, on the two sides of the opening 32, there are situated the guide ribs 33.

The jig rod 12 can be inserted more deeply than the flexible plate 41 and wide width portion 43 of the provisionally-retaining projecting portion 39. That is, the jig rod 12 can be inserted deeply in an area ranging from the opening 32 to the side wall 61 of the narrow width portion 29 (see FIG. 3). However, if the jig rod 12 is thin, the jig rod 12 can be inserted deeply in an area ranging from the opening 32 to the narrow width portion 29. The deep insertion of the jig rod 12 makes it possible to push up the provisionally-retaining projecting portion 39 positively. In the meantime, in FIG. 5, reference numeral 62 designates a waterproof packing, reference numeral 63 designates a partition wall portion of the terminal receiving chamber 16, reference numeral 64 designates a slide engaging portion which can be engaged with a vehicle body or the like, and reference numeral 65 designates a lock projection.

In the provisionally retained state of the front holder 4 in FIG. 5, the jig rod 12 is inserted from the opening 7*a* of the lock arm 8 into the opening 32 of the male housing part 5. The leading end 12*a* of the jig rod 12 is firstly butted against the upper end face of the side wall 61 of the narrow width portion (see FIG. 3) of the vertical guide gap 25. Next, the jig rod 12 is rotated backwardly in such a manner as shown by an arrow A due to leverage with the connecting portion 13 of the lock arm 8 as a fulcrum, so that the leading end of the provisionally-retaining projecting portion 39 of the front holder 4, that is, the leading end of the flexible plate 41 or the leading end of the wide width portion of the slide portion 42 is pushed up by the leading end 12*a* of the jig rod 12. In the meantime, the above structure is also effective when it is used as a method for removing the provisionally retained state of the front holder 4.

Figure 6:
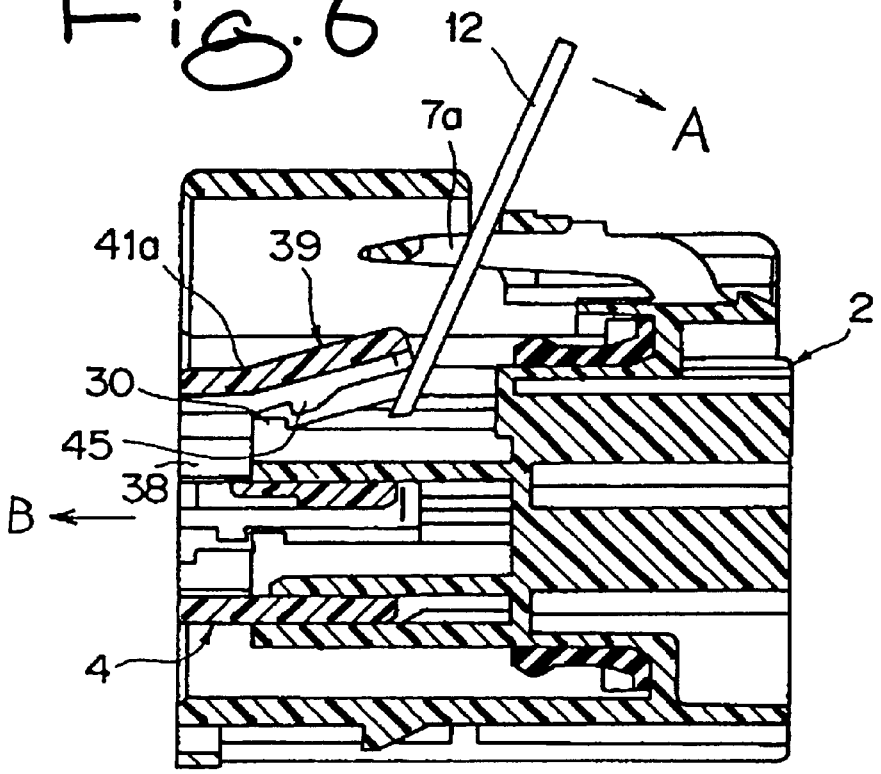
FIG. 6 is a longitudinal sectional view of the above embodiment, showing a state in which a provisionally-retaining projecting portion employed in the above embodiment is flexed.
Figure 7:
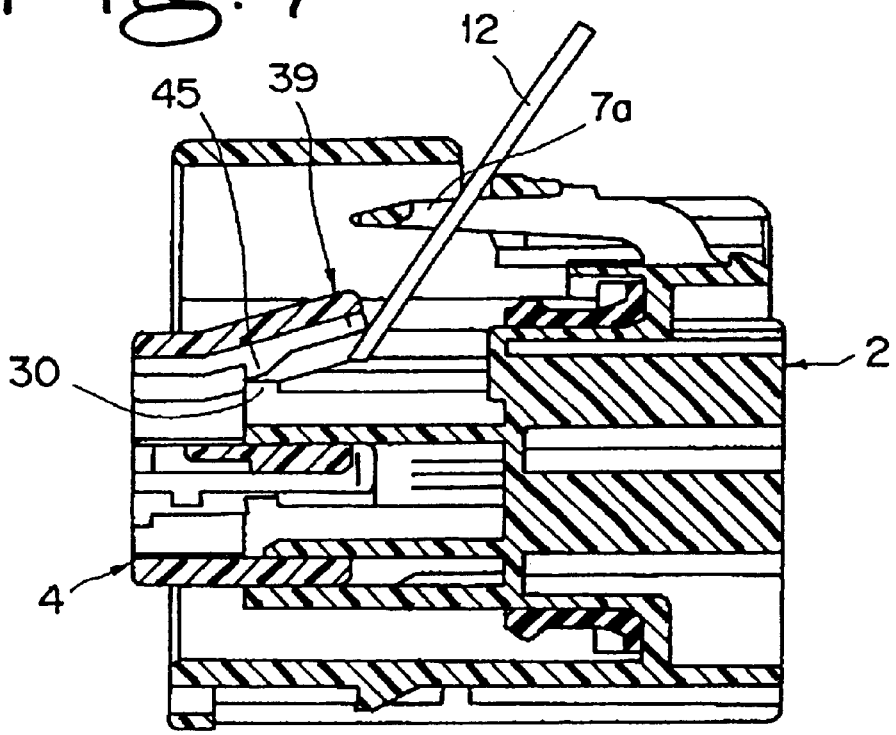
FIG. 7 is a longitudinal sectional view of the above embodiment, showing a state in which the front holder is pushed out.

As a result of this, as shown in FIG. 6, the provisionally-retaining projecting portion 39 of the front holder 4 is flexed upwardly from the root portion 41*a* of the frame-shaped portion 38, so that the engagement between the provisionally retaining projection 45 and provisionally engaging projection 30 can be removed. At the same time when the provisionally retained state is removed, the pushing force of the jig rod 12 is allowed to operate in the removing direction (in a direction of an arrow B in FIG. 6), so that, as shown in FIG. 7, the front holder 4 is pushed out forwardly in an inertial manner. The provisionally retaining projection 45 is allowed to pass over the provisionally engaging projection 30. The moment the front holder 4 is removed, the provisionally-retaining projecting portion 39 of the front holder 4 is returned to its original position.

As described above, the provisionally retained state of the front holder 4 can be removed simply with a small force due to the specific operation of the jig rod 12. Also, the front holder 4 is situated within the hood part 6 while the front holder 4 is provisionally retained and the provisionally retained state of the front holder 4 cannot be removed unless the jig rod 12 is used; that is, even if the force for retaining the front holder 4 is small, there is no fear that the front holder 4 can be removed (slipped off) unexpectedly in a wire harness manufacturing process or the like. Further, since the provisionally-retaining projecting portion 39 can be flexed in the removing direction simply by pushing the jig rod 12 lightly, there is no fear that the provisionally retaining projection 45 and provisionally engaging projection 30 can be damaged. In addition, by inserting the jig rod 12 into the opening 7*a* of the lock arm 8, the leading end portion of the jig rod 12 can be positioned accurately just before the provisionally-retaining projecting portion 39, which makes it possible to carry out the abovementioned pushing operation positively.

Figure 9:
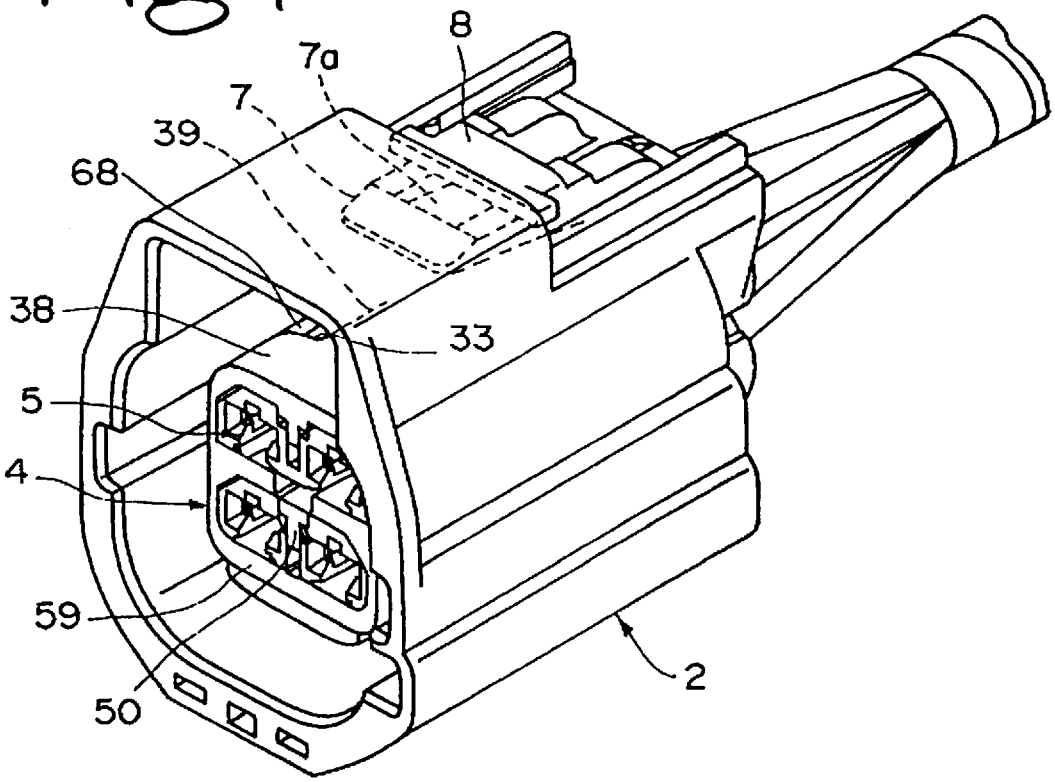
FIG. 9 is a perspective view of the above embodiment, showing a state in which the front holder is primarily retained.

Now, FIGS. 8 and 9 respectively show a state in which the front holder 4 is primarily retained to the connector housing 2. The primarily retained state of the front holder 4 can be obtained simply by pushing the front holder 4 from the provisionally retained state thereof shown in FIG. 5 further into the connector housing 2. In FIG. 5, the primarily retaining projections 51 are moved beyond and engaged with the primarily engaging projections 31, respectively. When the primarily retaining projections 51 are moving beyond the primarily engaging projections 31, the primarily retaining arm 50 is flexed upwardly; and, the instant the former have moved beyond the latter, the primarily retaining arm 50 is returned to its original position.

In FIG. 8, the female terminal 3 is inserted while the front holder 4 is provisionally retained. In the primarily retained state of the front holder 4, the leading end side small thickness portion 57 of the lower slide plate 56 advances into the flexure space 52 of the flexible retaining lance 21 to thereby prevent the flexible retaining lance 21 from being flexed. As shown in FIG. 9, the frame-shaped portion 38 of the front holder 4 is positioned while it in fit with the outside of the male housing part 5. The rear end of the frame-shaped portion 38 is situated on the same plane with the front end of the male housing part 5. The primarily retained state can be removed simply: that is, the leading end of the primarily retaining arm 50 is lifted up by a jig rod (not shown) and, at the same time, the jig rod 12 is inserted from the opening 7*a* of the lock arm 8 to thereby push the provisionally-retaining projecting portion 39 in the removing direction.

As has been described above, according to the first aspect of the present invention, if the flexible, provisionally-retaining projecting portion is pushed in the flexing direction by the jig rod, the provisionally retained state, that is, the engagement between the provisionally retaining portion and provisionally engaging portion can be removed simply. Since the provisionally-retaining projecting portion is flexible, there is eliminated the fear that the provisionally retaining portion and provisionally engaging portion can receive an unreasonable force when removing the provisionally retained state of the front holder, thereby preventing them against damage. Also, according to the second aspect of the present invention, it is not necessary to provide a special opening for insertion of the jig rod, which can save the cost for manufacturing a metal mold for forming such special opening and which can prevent the connector housing from being lowered in strength. Further, according to the third aspect of the present invention, due to the leverage of the jig rod, the provisionally-retaining projecting portion can be flexed easily with a small force. Still further, according to the fourth aspect of the present invention, since the leading end of the jig rod is inserted deep into the guide portion from the opening, the provisionally-retaining projecting portion of the front holder can be pushed positively by the jig rod, which makes it possible to remove the provisionally retained state of the front holder positively. Yet further, according to the fifth aspect of the present invention, because the front holder is kept from interfering with any external element while it is retained provisionally, the unexpected removal of the front holder can be prevented and the front holder retaining force can be reduced to thereby be able to enhance the efficiency of the front holder retaining operation as well as the front holder retained state removing operation.

What is claimed is:

1. A connector, comprising:

a connector housing including a terminal receiving chamber and a provisionally engaging portion;

a terminal insertable into the terminal receiving chamber; and a front holder insertable into the connector housing to retain the terminal in the terminal receiving chamber, the front holder including a provisionally-retaining projecting portion having flexibility, the provisionally-retaining projecting portion including a provisionally retaining portion engageable with the provisionally engaging portion of the connector housing;

wherein the connector housing includes a first opening which allows access of a jig rod to the provisionally-retaining projecting portion of the front holder when the front holder is held in the provisionally retained state, and wherein the connector housing further includes a guide portion therein for sliding engagement with respect to the provisionally-retaining projecting portion of the front holder, the guide portion has a second opening into which a leading end of the jig rod is insertable to access said provisionally-retaining projecting portion when the front holder is held in the provisionally retained state.

2. The connector of claim 1, wherein an end edge of the first opening operates as a leverage fulcrum with respect to the jig rod.

3. The connector of claim 2, wherein the connector housing further includes a guide portion for sliding engagement with respect to the provisionally-retaining projecting portion of the front holder, the guide portion has a second opening into which a leading end of the jig rod is insertable.

4. The connector of claim 1, wherein the entire front holder is stored within an interior of the connector housing when the front holder is held in the provisionally retained state.

5. The connector of claim 2, wherein the entire front holder is stored within an interior of the connector housing when the front holder is held in the provisionally retained state.

6. The connector of claim 3, wherein the entire front holder is stored within an interior of the connector housing when the front holder is held in the provisionally retained state.

7. The connector of claim 1, wherein said first and second openings are positioned relative to one another so that the jig rod is skew to the direction that the front holder is inserted within the housing.

8. The connector of claim 1, wherein said second opening is offset from the first opening toward the interior of the housing, and is slightly forward of the first opening in the direction that the holder is inserted into the housing.

9. A connector comprising:

a connector housing including a terminal receiving chamber and a provisionally engaging portion;

a terminal insertable into the terminal receiving chamber; and a front holder insertable into the connector housing to retain the terminal in the terminal receiving chamber, the front holder including a provisionally-retaining projecting portion having flexibility, the provisionally-retaining projecting portion including a provisionally retaining portion engageable with the provisionally engaging portion of the connector housing;

wherein the connector housing includes a first opening which allows access of a jig rod to the provisionally-retaining projecting portion of the front holder when the front holder is held in the provisionally retained state, wherein the connector hosing further includes a flexible lock arm, and wherein the first opening is formed in the flexible lock arm, the first opening serves also as a lock hole with respect to a mating connector.

10. The connector of claim 9, wherein an end edge of the first opening operates as a leverage fulcrum with respect to the jig rod.

11. The connector of claim 9, wherein the connector housing further includes a guide portion for sliding engagement with respect to the provisionally-retaining projecting portion of the front holder, the guide portion has a second opening into which a leading end of the jig rod is insertable.

12. The connector of claim 10, wherein the connector housing further includes a guide portion for sliding engagement with respect to the provisionally-retaining projecting portion of the front holder, the guide portion has a second opening into which a leading end of the jig rod is insertable.

13. The connector of claim 9, wherein the front holder is stored into an interior of the connector housing when the front holder is held in the provisionally retained state.

14. The connector of claim 10, wherein the front holder is stored into an interior of the connector housing when the front holder is held in the provisionally retained state.

15. The connector of claim 11, wherein the front holder is stored into an interior of the connector housing when the front holder is held in the provisionally retained state.

16. The connector of claim 12, wherein the front holder is stored within an interior of the connector housing when the front holder is held in the provisionally retained state.

* * * * *